US007460682B2

(12) United States Patent
Suzuki

(10) Patent No.: US 7,460,682 B2
(45) Date of Patent: Dec. 2, 2008

(54) VOICE COIL, SPEAKER APPARATUS USING THE VOICE COIL, AND METHOD FOR MANUFACTURING THE SPEAKER APPARATUS

(75) Inventor: Tatsuya Suzuki, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 775 days.

(21) Appl. No.: 11/033,270

(22) Filed: Jan. 12, 2005

(65) Prior Publication Data

US 2005/0152572 A1 Jul. 14, 2005

(30) Foreign Application Priority Data

Jan. 14, 2004 (JP) ..... P2004-007092

(51) Int. Cl.
*H04R 25/00* (2006.01)

(52) U.S. Cl. ..... 381/410; 381/409; 381/407

(58) Field of Classification Search ..... 381/403, 381/404, 407, 409, 410, 398, 400, 430, 433; 29/594, 609.1
See application file for complete search history.

(56) References Cited

U.S. PATENT DOCUMENTS

| | | | | |
|---|---|---|---|---|
| 5,014,323 | A * | 5/1991 | Markow et al. | 381/409 |
| 5,249,236 | A * | 9/1993 | Sakamoto | 381/409 |
| 7,245,739 | B2 * | 7/2007 | Suzuki | 381/430 |
| 7,336,798 | B2 * | 2/2008 | Ono et al. | 381/433 |

FOREIGN PATENT DOCUMENTS

JP 7-288894 A 10/1995

* cited by examiner

*Primary Examiner*—Huyen D Le
(74) *Attorney, Agent, or Firm*—Sughrue Mion, PLLC

(57) ABSTRACT

There is provided a speaker apparatus manufactured by using a voice coil configured so that a lead wire electrically connected to a coil is clamped between an insulating sheet and a bobbin.

3 Claims, 5 Drawing Sheets

VOICE COIL, SPEAKER APPARATUS USING THE VOICE COIL, AND METHOD FOR MANUFACTURING THE SPEAKER APPARATUS

CROSS-REFERENCE TO RELATED APPLICATION

The invention claims priority to Japanese Patent Application No. JP 2004-007092 filed on Jan. 14, 2004. The disclosure of the prior application is incorporated herein by reference in its entirety.

BACKGROUND OF THE INVENTION

1. Field of the Invention

The present invention relates to a voice coil, a speaker apparatus using the voice coil, and a method for manufacturing the speaker apparatus.

2. Description of the Related Art

FIG. 1 shows a configuration of a voice coil for use in a conventional electrodynamic speaker apparatus.

As shown in FIG. 1, a conventional voice coil 300 has a coil 102 wound around a periphery of a bobbin 101, and a reinforcing tape 107 is stuck to a portion above the coil 102. Cutout portions 108*a*, 108*b*, 109*a* and 109*b* are provided on upper and lower portions of the reinforcing tape 107, and both ends of the coil 102 are respectively soldered and electrically connected to lead wires 105 at connection portions 106 at the cutout portions 109*a* and 109*b* (refer to JP-A-7-288894, for example).

Since the coil of the voice coil (aluminum wire in particular) is inferior in wire flexibility, the coil is soldered in the manner so that the coil is electrically connected to lead wires such as copper wires having superior flexibility.

There is another configuration in which both ends of a coil of a voice coil and lead wires are electrically connected by being respectively soldered to copper foils stuck to a surface of a bobbin.

SUMMARY OF THE INVENTION

However, a conventional voice coil has a structure that lead wires are extended to outside directly from connection portions where the respective lead wires and both ends of coil are connected to each other or connected to respective copper foils, so that there occurs a problem that when external force acting to pull the lead wires is applied to the voice coil, the lead wires are likely to be broken by peeling of solder.

In a manufacturing process for a speaker apparatus using the conventional voice coil, there occurs a problem that when an edge and the voice coil are to be fixed with an adhesive, a nozzle for adhesive injection and a lead wire interfere with each other and the lead wire is broken, or the injected adhesive flows into an unintended portion along the lead wire to cause manufacturing failure or the like.

Examples of problems that the invention is to solve are, as mentioned above in the conventional art, the problem that lead wires are likely to be broken and the problem that manufacturing failure is likely to be caused by in-flow of an adhesive injected in the manufacturing process of a speaker apparatus.

According to an embodiment of the invention, there is provided a voice coil including: a coil; a lead wire electrically connected to the coil; a bobbin; and an insulating sheet, wherein the lead wire is clamped between an insulating sheet and a bobbin.

According to another embodiment of the invention, there is provided a voice coil including an electrically conductive bobbin; a coil wound on a surface of the bobbin; a first insulating sheet stuck to the surface of the bobbin above the coil; a second insulating sheet having a metal foil stuck to a part of the surface of the first insulating sheet; a first connection portion where the metal foil and an end of the coil are electrically connected to each other; a second connection portion where the metal foil and an end of a lead wire are electrically connected to each other; and a third insulating sheet stuck so as to clamp the lead wire between the third insulating sheet and the bobbin.

According to still another embodiment of the invention, there is provided a voice coil including: an insulative bobbin; a coil wound on a surface of the bobbin; a metal foil stuck to a part of the surface of the bobbin; a first connection portion where the metal foil and an end of the coil are electrically connected to each other; a second connection portion where the metal foil and an end of a lead wire are electrically connected to each other; and an insulating sheet stuck so as to clamp the lead wire between the insulating sheet and the bobbin.

According to yet still another embodiment of the invention, there is provided a speaker apparatus including a voice coil according to the above embodiments.

According to yet still another embodiment of the invention, there is provided a method of manufacturing a speaker apparatus including steps of: clamping a lead wire electrically connected to a coil between an insulating sheet and a bobbin; and subsequently supplying an adhesive between the voice coil and an edge inner circumferential portion from a nozzle.

BRIEF DESCRIPTION OF THE DRAWING

These and other objects and advantages of this invention will become more fully apparent from the following detailed description taken with the accompanying drawings in which.

DETAILED DESCRIPTION OF THE PREFERRED EMBODIMENTS

A preferred embodiment of a voice coil according to the invention and a speaker apparatus using the voice coil will be described below in detail with reference to accompanying drawings.

Figure 1:
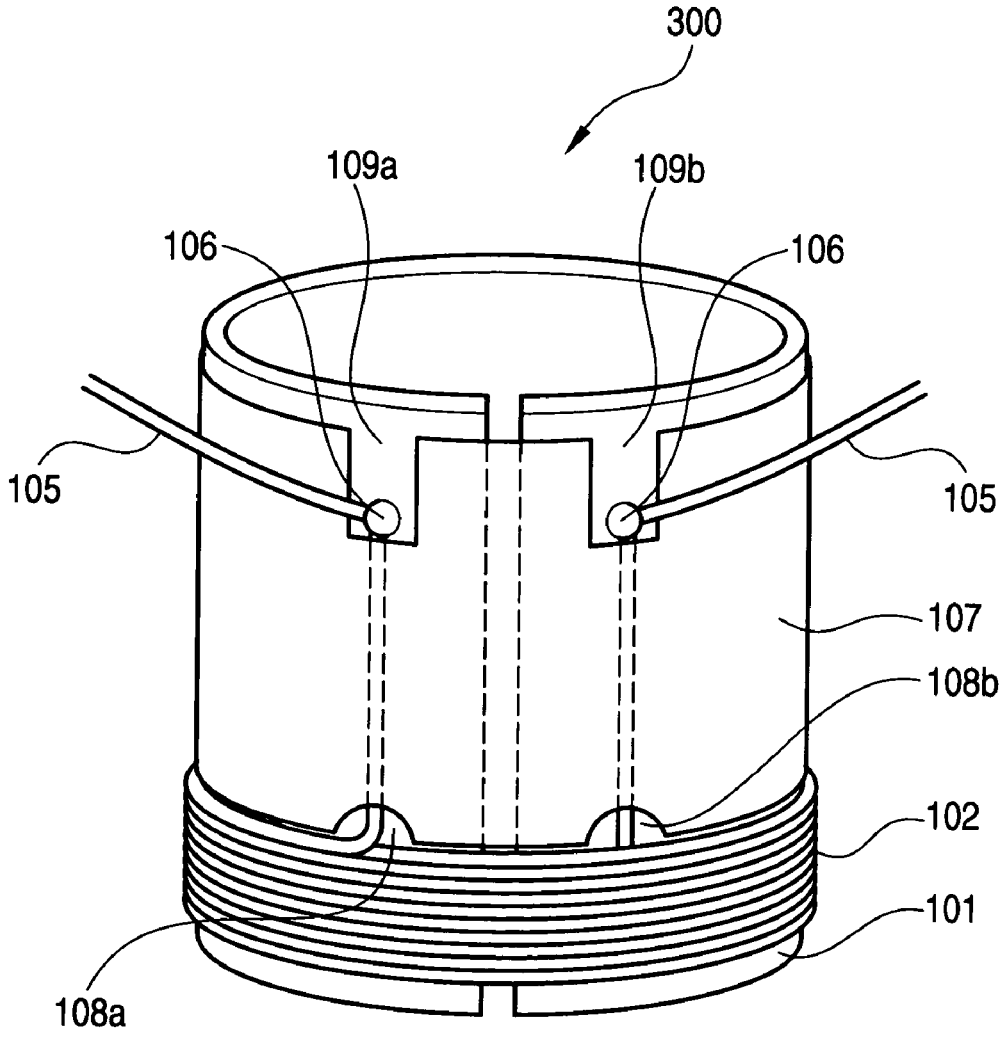
FIG. 1 PRIOR ART
FIG. 1 is a perspective view showing a configuration of a conventional voice coil.
Figure 2:
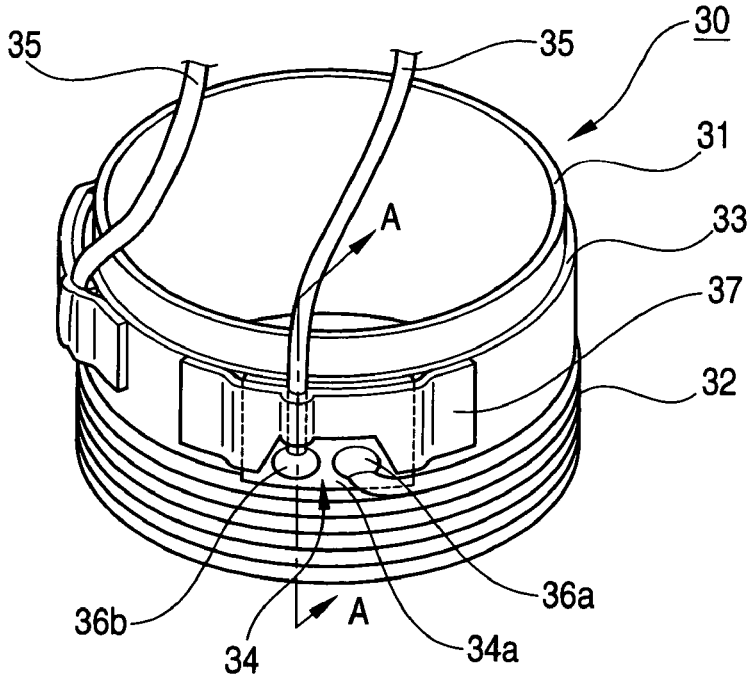
FIG. 2 is a perspective view showing a voice coil according to an embodiment of the invention.
Figure 3:
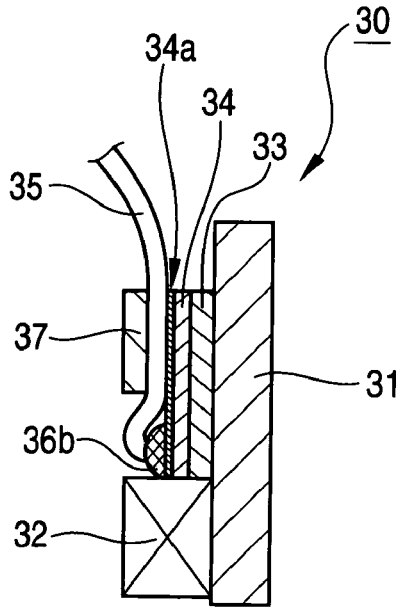
FIG. 3 is a cross-sectional view taken along line A-A of FIG. 2.

FIG. 2 is a perspective view of a voice coil according to an embodiment of the invention, and FIG. 3 is a cross-sectional view taken along line A-A of FIG. 2.

As shown in FIGS. 2 and 3, a voice coil 30 according to the embodiment includes a metal (electrically conductive) cylindrical bobbin 31 made of a thin plate of aluminum or the like, a coil 32 wound around a surface of the bobbin 31, a first insulating sheet 33 stuck to the surface of the bobbin 31 above the coil 32, and a second insulating sheet 34 having a copper foil (a metal foil) 34*a* stuck to its surface, and the second insulating sheet 34 is stuck to a part of a surface of the first insulating sheet 33, and the copper foil 34*a* and one end of the coil 32 are electrically connected to each other by being soldered together at a first connection portion 36*a*.

The copper foil 34*a* and an end of a lead wire 35 are electrically connected to each other by being soldered together at a second connection portion 36*b*.

In this manner, the one end of the coil 32 and the lead wire 35 are electrically connected to each other through the copper foil 34*a*.

In addition, a third insulating sheet 37 is stuck in such a manner that the lead wire 35 is clamped between the third insulating sheet 37 and the copper foil 34*a* in a state of extending along an axial direction of the bobbin 31.

In addition, the adhesion between the third insulating sheet 37 and the bobbin 31 is increased by applying an adhesive or the like in a manufacturing process of a speaker apparatus which will be described later, whereby the lead wire 35 clamped by the third insulating sheet 37 can be fixed to the bobbin 31.

The lead wire 35 can make use of a lead wire made of a material such as copper having flexibility and bend resistance.

Although FIG. 2 shows a connecting state where the one end of the coil 32 and the lead wire 35 are connected to each other, another end of the coil 32 is similarly electrically connected to the lead wire 35.

In FIG. 2, the third insulating sheet 37 is formed in a shape of uncovering the connection portions 36*a* and 36*b*, but the third insulating sheet 37 may also be formed in the shape of covering part or the whole of these connection portions 36*a* and 36*b*.

The bobbin 31 may not be made of metal (electrical conductivity), and may also be made of one of materials such as plastic and paper or a compound material thereof.

In the case of a voice coil including an electrically insulative bobbin, the first insulating sheet 33 need not be used, and the voice coil needs only to have at least a coil wound around the surface of the bobbin, a metal foil stuck to part of the surface of the bobbin, a first connection portion where the metal foil and an end of the coil are electrically connected to each other, a second connection portion where the metal foil and another end of the coil are electrically connected to each other, and an insulating sheet stuck in such a manner that the lead wire is clamped between the insulating sheet and the bobbin.

One example of a speaker apparatus using the voice coil according to the embodiment will be described below with reference to FIGS. 4 and 5.

Figure 4:
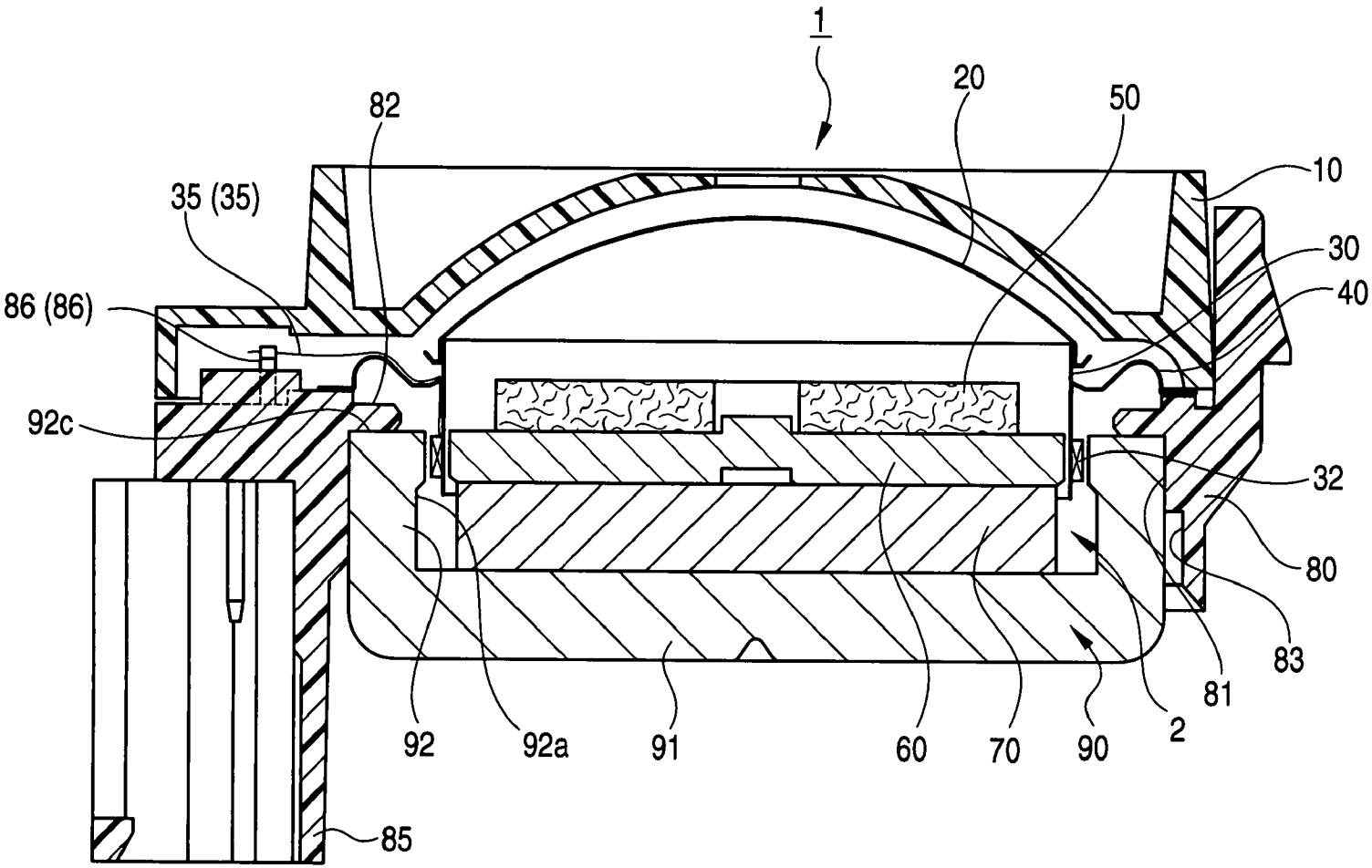
FIG. 4 is a cross-sectional view showing one example of a speaker apparatus using the voice coil according to the embodiment of the invention.
Figure 5:
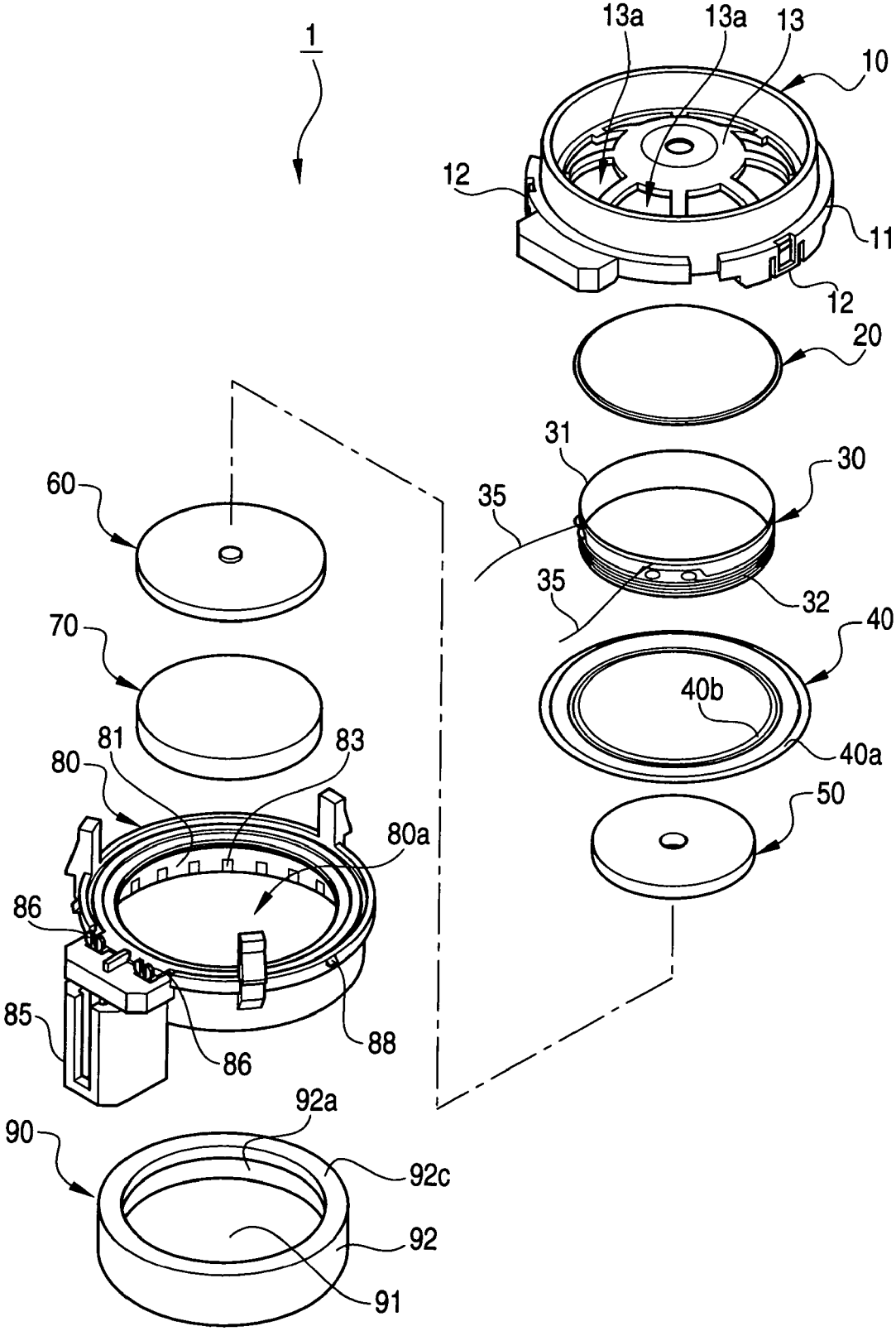
FIG. 5 is an exploded perspective view showing the example of the speaker apparatus using the voice coil according to the embodiment of the invention.

FIG. 4 is a cross-sectional view showing a speaker apparatus 1 using the voice coil 30 according to the embodiment, and FIG. 5 is an exploded perspective view of the speaker apparatus 1.

The speaker apparatus 1 according to the embodiment is a so-called dome-type speaker apparatus, and, as shown in FIGS. 4 and 5, has a cover 10, a diaphragm 20, the voice coil 30, an edge 40, a sound absorbing material 50, a top plate 60, a magnet 70, a frame 80, and a pot type yoke 90.

In the speaker apparatus 1 according to the embodiment, the pot type yoke 90 is adhesively fixed to the frame 80 having a annular shape whose central portion is formed with an opening 80*a*, in the state of being fitted along an inner circumferential surface 81 of the frame 80, and the magnet 70, the top plate 60 and the sound absorbing material 50 are stacked on the pot type yoke 90 in this order. In the speaker apparatus 1 according to the embodiment, its magnetic circuit is configured with the top plate 60, the magnet 70 and the pot type yoke 90.

The pot type yoke 90 is a metal-made yoke having a disk-shaped bottom portion 91 and a annular wall portion 92 which is formed upright at the peripheral edge of the bottom portion 91, and has an approximately C-like shape in cross section. This pot type yoke 90 is formed by applying forging and cutting to a metal which is a base material, whereby the bottom portion 91 and the wall portion 92 are integrally formed.

The pot type yoke 90 is positioned with respect to the frame 80 in such a manner that a top end 92*c* of the wall portion 92 is brought into contact with an annular rib 82 which is projected from the inner circumferential surface 81 of the frame 80, and the pot type yoke 90 is adhesively fixed to the frame 80 in this state by an adhesive poured into a plurality of adhesive pockets 83 formed to be spaced in the circumferential direction of the inner circumferential surface 81.

The magnet 70, the top plate 60 and the sound absorbing material 50 are stacked in this order on the bottom portion 91 of the pot type yoke 90. The top plate 60 and the magnet 70 are disk-shaped members, and are fixed to be spaced a predetermined distance apart from an inner circumferential surface 92*a* of the wall portion 92 of the pot type yoke 90. In this manner, a magnetic gap 2 is formed between the inner circumferential surface 92*a* of the wall portion 92 of the pot type yoke 90 and the top plate 60 as well as the magnet 70.

The voice coil 30 according to the embodiment of the invention is disposed in the magnetic gap 2. The lead wires 35 extended from the voice coil 30 are respectively connected to terminals 86 provided in a connector portion 85 formed integrally with the frame 80. A connecting cable connected to an amplifier which is not shown is connected to this connector portion 85. Accordingly, an electric current output from the amplifier in response to a sound signal flows into the coil 32 through the connector portion 85 and the lead wires 35.

One axial end of the bobbin 31 is connected to the diaphragm 20. The diaphragm 20 has a dome-like shape, and generates sound by vibrating according to the driving of the voice coil 30 by the electric current flowing in the coil 32 of the voice coil 30.

The annular edge 40 is disposed to extend around the bobbin 31. The edge 40 has an outer circumferential end 40*a* fixed to the frame 80, and holds the bobbin 31 by means of an inner circumferential portion 40*b*. As will be described later, the edge inner circumferential portion 40*b* and the bobbin 31 are adhesively fixed to each other by a poured adhesion.

The cover 10 is disposed over the diaphragm 20. The cover 10 is formed in a dome-like shape corresponding to the shape of the diaphragm 20, and is positioned and fixed to the frame 80 in such a manner that a plurality of engagement parts 12 formed in the circumferential direction of a peripheral wall 11 are respectively brought in engagement with engagement projections 88 formed on the frame 80. A dome portion 13 of the cover 10 has a plurality of sound emitting holes 13*a* for emitting sound generated from the diaphragm 20, and is constructed so that the diaphragm 20 is physically protected from the outside and sound generated from the diaphragm 20 is appropriately emitted.

The speaker apparatus of the invention is not limited to the above embodiment, and may be of any type that includes a voice coil having a lead wire electrically connected to a coil and clamped between an insulating sheet and a bobbin.

A method of coating an adhesive between the edge inner circumferential portion 40*b* and the voice coil 30 in a manufacturing process for the speaker apparatus 1 using the voice coil according to the embodiment will be described below with reference to FIG. 6.

Figure 6:
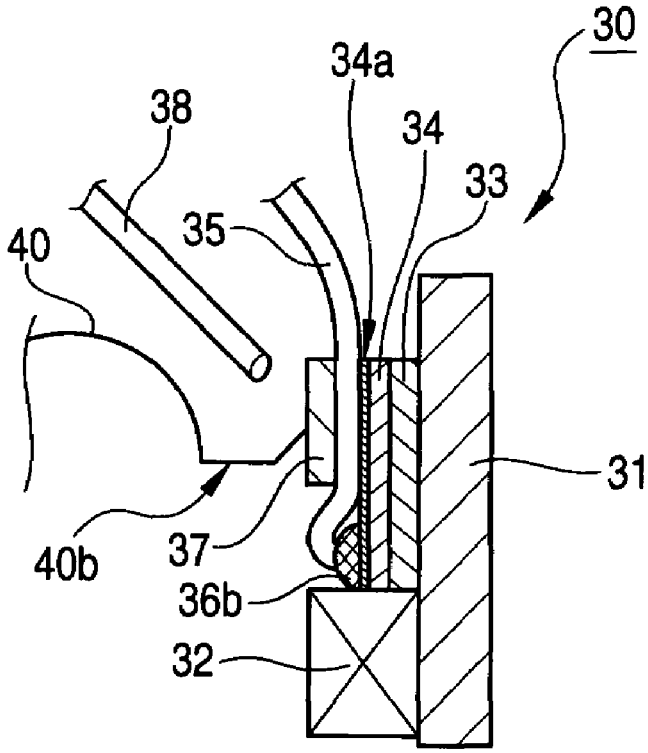
FIG. 6 is a cross-sectional view showing a method of coating an adhesive in a manufacturing process for the speaker apparatus according to the embodiment of the invention.

FIG. 6 is a cross-sectional view of the voice coil 30 and the edge inner circumferential portion 40*b*. As shown in FIG. 6, a nozzle 38 for adhesive injection is made closer to a coating target portion in order to coat an adhesion between the voice coil 30 and the edge inner circumferential portion 40*b*.

Then, the adhesive is coated by being supplied from the nozzle 38 around the entire circumference between the voice coil 30 and the edge inner circumferential portion 40*b*.

Then, after the supply of the adhesive is completed, the nozzle 38 is moved away from the coating target portion.

As described hereinabove in detail, the voice coil 30 according to the embodiment is configured in such a manner that the lead wire 35 electrically connected to the coil 32 is clamped between the third insulating sheet 37 and the bobbin 31, whereby even if external force acting to pull the lead wire 35 is applied to the voice coil 30, this external force is not directly applied to the second connection portion 36*b* where the copper foil 34*a* and the one end of the lead wire 35 are soldered together, so that it is possible to prevent the lead wire 35 from being broken by causes such as peeling of solder.

In the speaker apparatus 1 using the voice coil 30 according to the embodiment, the lead wire 35 electrically connected to the coil 32 is clamped between the third insulating sheet 37 and the bobbin 31 before the adhesive is supplied between the voice coil 30 and the edge inner circumferential portion 40*b* from the nozzle 38. Accordingly, it is possible to prevent the problem that, during the coating of the adhesive, the nozzle 38 and the lead wire 35 interfere with each other to break the lead wire 35 or the injected adhesive flows into an unintended portion along the lead wire 35 to cause manufacturing failure or the like.

The foregoing description of embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A voice coil comprising:

an electrically conductive bobbin;

a coil wound on a surface of the bobbin;

a first insulating sheet stuck to the surface of the bobbin above the coil;

a second insulating sheet having a metal foil stuck to a part of the surface of the first insulating sheet;

a first connection portion where the metal foil and an end of the coil are electrically connected to each other;

a second connection portion where the metal foil and an end of a lead wire are electrically connected to each other; and a third insulating sheet stuck so as to clamp the lead wire between the third insulating sheet and the bobbin.

2. The voice coil according to claim 1, wherein the lead wire is clamped in a state of extending along an axial direction of the bobbin.

3. A speaker apparatus comprising:

a voice coil including an electrically conductive bobbin;

a coil wound on a surface of the bobbin;

a first insulating sheet stuck to the surface of the bobbin above the coil;

a second insulating sheet having a metal foil stuck to a part of the surface of the first insulating sheet;

a first connection portion where the metal foil and an end of the coil are electrically connected to each other;

a second connection portion where the metal foil and an end of a lead wire are electrically connected to each other; and a third insulating sheet stuck so as to clamp the lead wire between the third insulating sheet and the bobbin.

* * * * *